US006336077B1

(12) United States Patent
Boucher

(10) Patent No.: US 6,336,077 B1
(45) Date of Patent: Jan. 1, 2002

(54) AUTOMATIC MONITORING AND DISPLAY SYSTEM FOR USE WITH A DIGGINS MACHINE

(76) Inventor: Gaétan Boucher, 1538, Basile Routhier, Ste-Julie Quebec (CA), J3H 1P7

( * ) Notice: Subject to any disclaimer, the term of this patent is extended or adjusted under 35 U.S.C. 154(b) by 0 days.

(21) Appl. No.: 09/326,322

(22) Filed: Jun. 7, 1999

(51) Int. Cl.[7] ..... G01B 3/00

(52) U.S. Cl. ..... 702/33; 37/348; 37/443; 700/61; 701/50; 702/166; 702/FOR 145; 702/FOR 146; 702/FOR 147

(58) Field of Search ..... 702/33, 166, FOR 145, 702/FOR 146, FOR 147; 37/348, 443; 700/61; 701/50

(56) References Cited

U.S. PATENT DOCUMENTS 4,491,927 A * 1/1985 Bachmann et al. ..... 364/561
5,371,959 A * 12/1994 Ash ..... 37/443
5,682,311 A * 10/1997 Clark ..... 364/424.07
5,848,485 A * 12/1998 Anderson et al. ..... 37/348
5,854,988 A * 12/1998 Davidson et al. ..... 701/50
5,933,346 A * 8/1999 Brabec et al. ..... 364/167.07

* cited by examiner

*Primary Examiner*—Arthur T. Grimley
*Assistant Examiner*—John Le
(74) *Attorney, Agent, or Firm*—Swabey Ogilvy Renault; Guy Houle

(57) ABSTRACT

An automatic monitoring and display system for use with a digging machine in order to excavate holes having a predetermined depth and an excavation slope pitch from ground level to hole depth. The machine has a boom, a dipper stick connected to the boom and a bucket at the end of the dipper stick, all interconnected by three pivots. Only two sensors are used to detect the position of the bucket relative to a zero reference signal which is stored in a processor. The operator of the machine has a console whereby to select an excavation depth as well as a slope pitch angle and the console will display to him the hole depth and the percentage pitch on the slope as the excavation proceeds. The operator can reset his zero reference signal at any time from anywhere.

9 Claims, 4 Drawing Sheets

AUTOMATIC MONITORING AND DISPLAY SYSTEM FOR USE WITH A DIGGINS MACHINE

TECHNICAL FIELD

The present invention relates to a programmable automatic monitoring and display system for use with a digging machine whereby to monitor the excavation of a hole having a preset desired depth and a slope pitch angle from ground level.

BACKGROUND ART

It is known in the art to provide automatic monitoring systems in association with digging machines whereby to preset in a computer a predetermined depth for an excavation and upon excavating the hole, signals are provided to the operator concerning the position of the digging teeth of the bucket relative to the desired depth. Accordingly, the operator is continuously aware of the depth of the hole, particularly, in instances where the position of the bucket teeth is not visible. It is important when excavating holes for foundations, etc., that the depth of the hole be maintained as close as possible to the desired depth. Most methods are manual and labor intensive as an assistant is required to effectuate the measurements and relay this information to the machine operator. Such a method is also dangerous since the assistant is exposed to all sorts of hazardous situations and particularly when the weather is inclement.

U.S. Pat. No. 4,491,927 discloses a depth monitoring system of the type as disclosed in the present application whereby a computer is utilized to compute the trigonometric relationship between the boom, dipper stick and bucket. In that particular patent, the trigonometric equation involves the addition of three angular relationships between the boom, dipper stick and the bucket. The depth of the hole is also measured from the top edge of a vertical surveyor stake implanted in the ground to serve as a reference guide. The stick has a predetermined height above the level of the ground and this height is subtracted by the computer from the inputted measurements. Because the system utilizes three sensors, the set-up of the computer is more complicated and time consuming. Also, it is susceptible to errors as the alignment of the bucket with the dipper stick is far away from the operator, who sits in the cabin of the machine, and it is difficult to align these perfectly by using the eye. Although this system is adequate for excavating holes primarily for foundations, it cannot excavate slope angles associated with the hole or slope excavation for existing holes or trenches, ditches, etc.

SUMMARY OF INVENTION

It is a feature of the present invention to provide an automatic monitoring and display system in combination with a digging machine for excavating a hole having both a predetermined depth and an excavation slope pitch from ground level and which substantially overcomes the above-mentioned disadvantage of the prior art.

Another feature of the present invention is to provide an automatic monitoring and display system in combination with a digging machine for excavating a hole having an excavation slope pitch from ground level to hole depth and wherein the system utilizes only two inclinometer sensors associated with a boom, a dipper stick and a bucket, all interconnected together and to the machine by three pivot points.

Another feature of the present invention is to provide an automatic monitoring and display system in combination with a digging machine for excavating a hole having an excavation slope pitch from ground level to hole depth and wherein the operator of the digging machine can reset a zero reference signal at any ground point to excavate a hole as well as a slope pitch from either the top ground level or the bottom ground level at the base of the excavation.

It is a further feature of the present invention to provide an automatic monitoring and display system in combination with a digging machine for excavating a hole having an excavation slope pitch from ground level to hole depth and wherein the bucket and dipper stick are aligned at a predetermined position during the set-up mode by visual aligning markers provided on the bucket and dipper stick.

According to the above features, from a broad aspect, the present invention provides an automatic monitoring and display system in combination with a digging machine for excavating a hole having a predetermined depth and an excavation slope pitch from ground level to hole depth. The digging machine has a boom with a first pivot at a near end connected to a machine body. A dipper stick is pivotally connected to a far end of the boom by a second pivot. A bucket is pivotally connected to a far end of the dipper stick by a third pivot. The bucket has digging teeth at an extreme lower edge thereof. A first inclinometer sensor is secured to the boom close to the first pivot. A second inclinometer sensor is secured to the dipper stick close to the second pivot. A first aligning marker is provided on the far end of the dipper stick and disposed for visual access to a machine operator position. A second marker is provided on the bucket and disposed for alignment with the first marker. The first and second markers, when aligned, position the digging teeth in alignment with a longitudinal axis of the dipper stick passing through the second and third pivot. Memory storage means is provided for storing signals indicative of boom length between the first and second pivot, combined length of the dipper stick and the bucket from the second pivot to the digging teeth of the bucket, and mathematical information for calculating excavation depth and excavation slope angle. Processor means is provided for processing position signals received from the first and second inclinometer sensors relative to a preset virtual zero signal. The processor means feeds resultant signals to a display processor means for providing a visual display to a machine operator indicative of excavation depth and excavation slope pitch. A console has a first function switch means for programming for desired hole excavation depth and a second function switch means for programming desired slope pitch.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
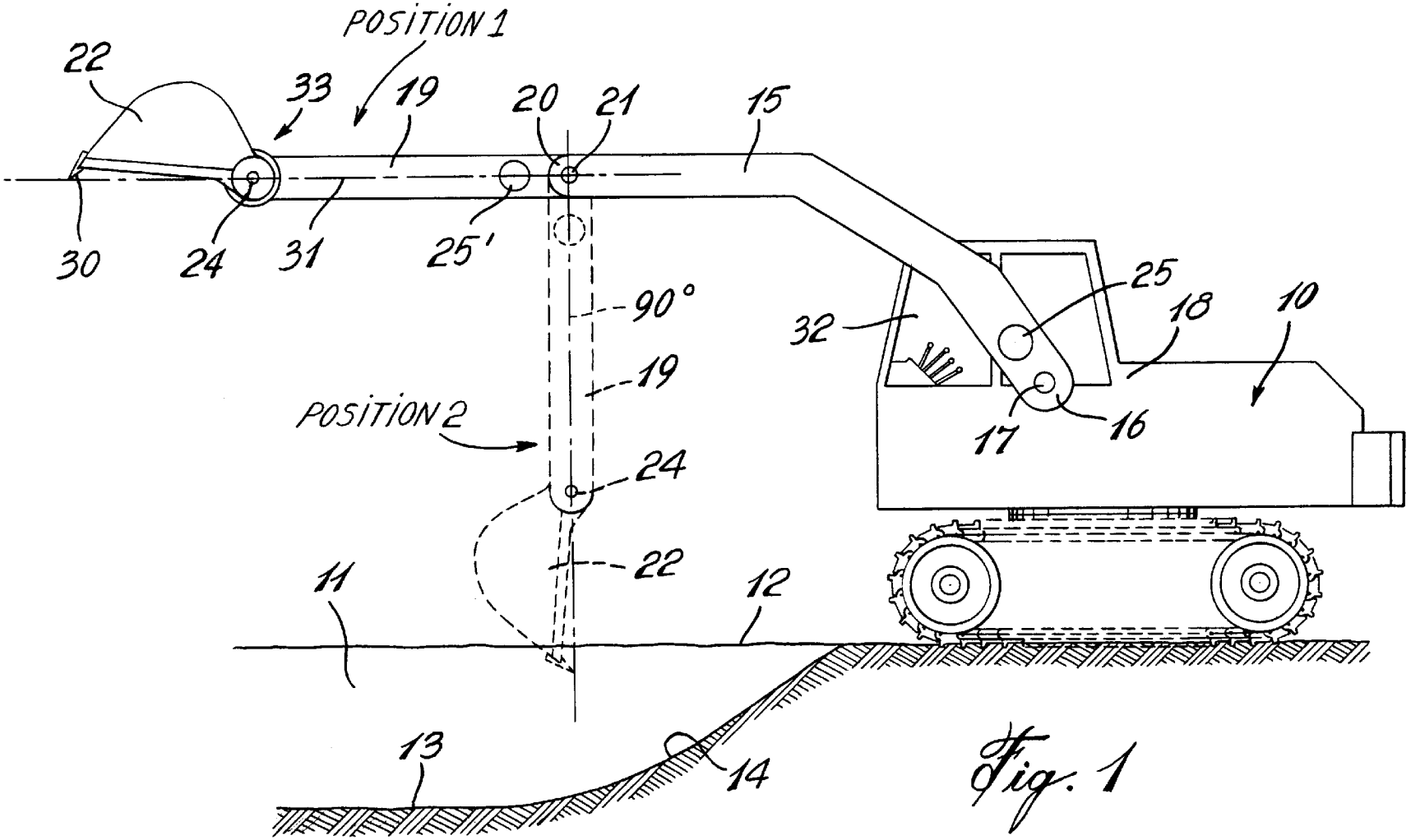
FIG. 1 is a schematic illustration of a digging machine incorporating inclinometers connected to the boom and dipper stick to feed information signals to a monitoring and display system located in the cabin to identify the position of the digging teeth of the bucket.

Referring now to the drawings and more particularly to FIG. 1, there is shown generally at 10 a digging machine for excavating a hole 11 having a predetermined depth from ground level 12 to hole bottom 13. An important aspect of the present invention is that the system can also excavate a slope pitch 14 having a predetermined inclination angle as desired by the operator and stored in the computerized system.

As hereinshown the digging machine 10 has a boom 15 which is secured at a near end 16 by a pivot connection 17 to the machine body 18. A dipper stick 19 is pivotally connected to the far end 20 of the boom 15 by a second pivot connection 21. A digging bucket 22 is also pivotally connected to the far end 23 of the dipper stick 19 by a third pivot connection 24. A first inclinometer sensor 25, and as will be described in more detail with respect to FIG. 3, later on, is secured to the boom 15 close to the first pivot connection 17. A second inclinometer sensor 25' is secured to the dipper stick close to the second pivot connection 21.

Figure 2A:
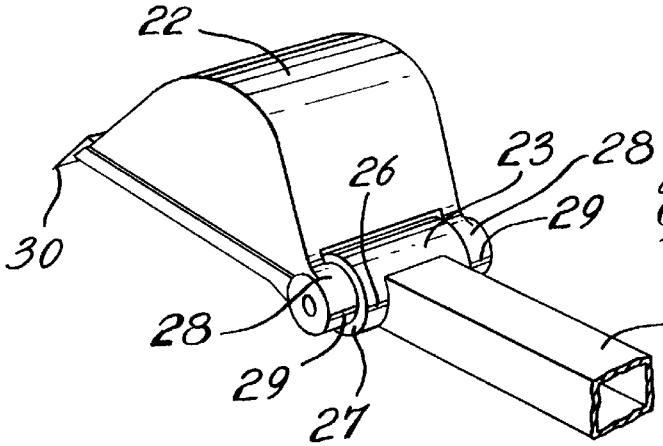
FIG. 2A is a fragmented perspective view illustrating the position of the visual aligning markers whereby to align the bucket teeth with a specific axis of the dipper stick.
Figure 2B:
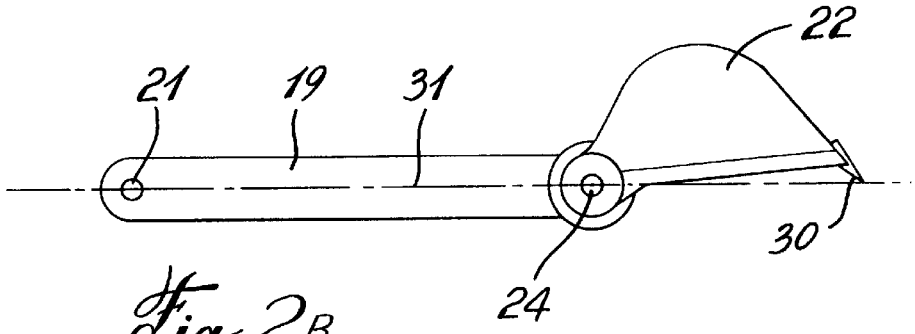
FIG. 2B is a side view of the dipper stick, and bucket illustrating their alignment with the specific axis.

As shown in FIG. 2, the digging bucket 22 and the far end section 23 of the dipper stick 19 are each provided with a visual aligning marker. As hereinshown a first marker 26 is permanently affixed on a portion 27 of the far end section 23 of the dipper stick on each side thereof adjacent to the bucket connecting flanges 28. A second position marker 29 is also permanently affixed to the connecting flanges 28 of the digging bucket 22. When these two visual markers are aligned one adjacent the other, the bucket digging teeth 30 as shown in FIG. 2B are positioned in alignment with a longitudinal axis 31 of the dipper stick 19 passing through the second and third pivot connections 21 and 24, respectively. This alignment is effectuated with the boom in any position such that the operator which is in the cabin 32 of the digging machine 10 has visual access thereto. This position is illustrated by reference numeral 33 in FIG. 1. This type of alignment aid is easy to set up, is error free, and saves time to the machine operator.

Figure 3:
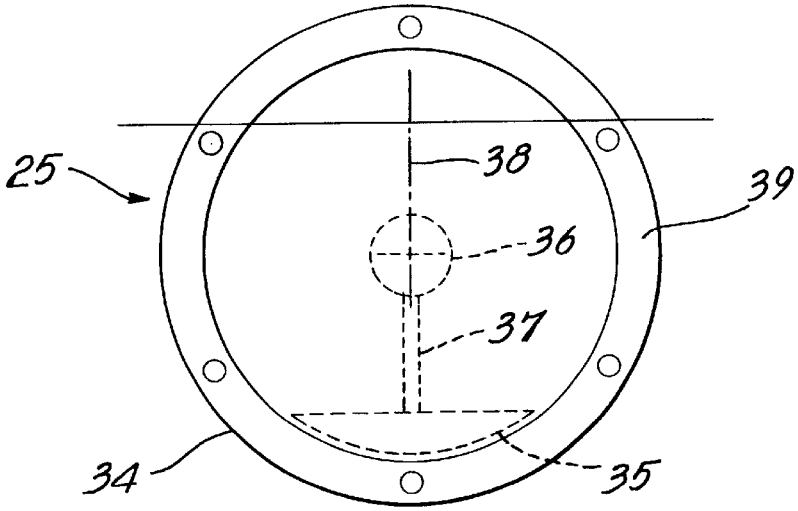
FIG. 3 is a simplified schematic plan view of an inclinometer sensor.

FIG. 3 illustrates the construction of one of the inclinometer sensors, herein sensor 25. As hereinshown each inclinometer sensor has a sealed housing 34 and a plumb weight 35 is secured therein on a pendulum connection which comprises a pivot connection 36 and a depending arm 37. The plumb weight 35 provides a signal of its true vertical position relative to the vertical axis 38. An attachment ring 39 is provided to connect the sensor to the boom and dipper stick. Accordingly, as the boom is displaced, the housing will be displaced but the plumb weight 35 will maintain its alignment with the true vertical axis 38. Accordingly, an angle signal will be generated concerning the position of the boom. The operation of this sensor is well known in the art. It also incorporates electronic circuits to generate these signals as well as a connector cable 40, see FIG. 4, to feed the signals to the electronic processing system 41 which is housed in the cabin 32 of the digging machine 10.

Figure 4:
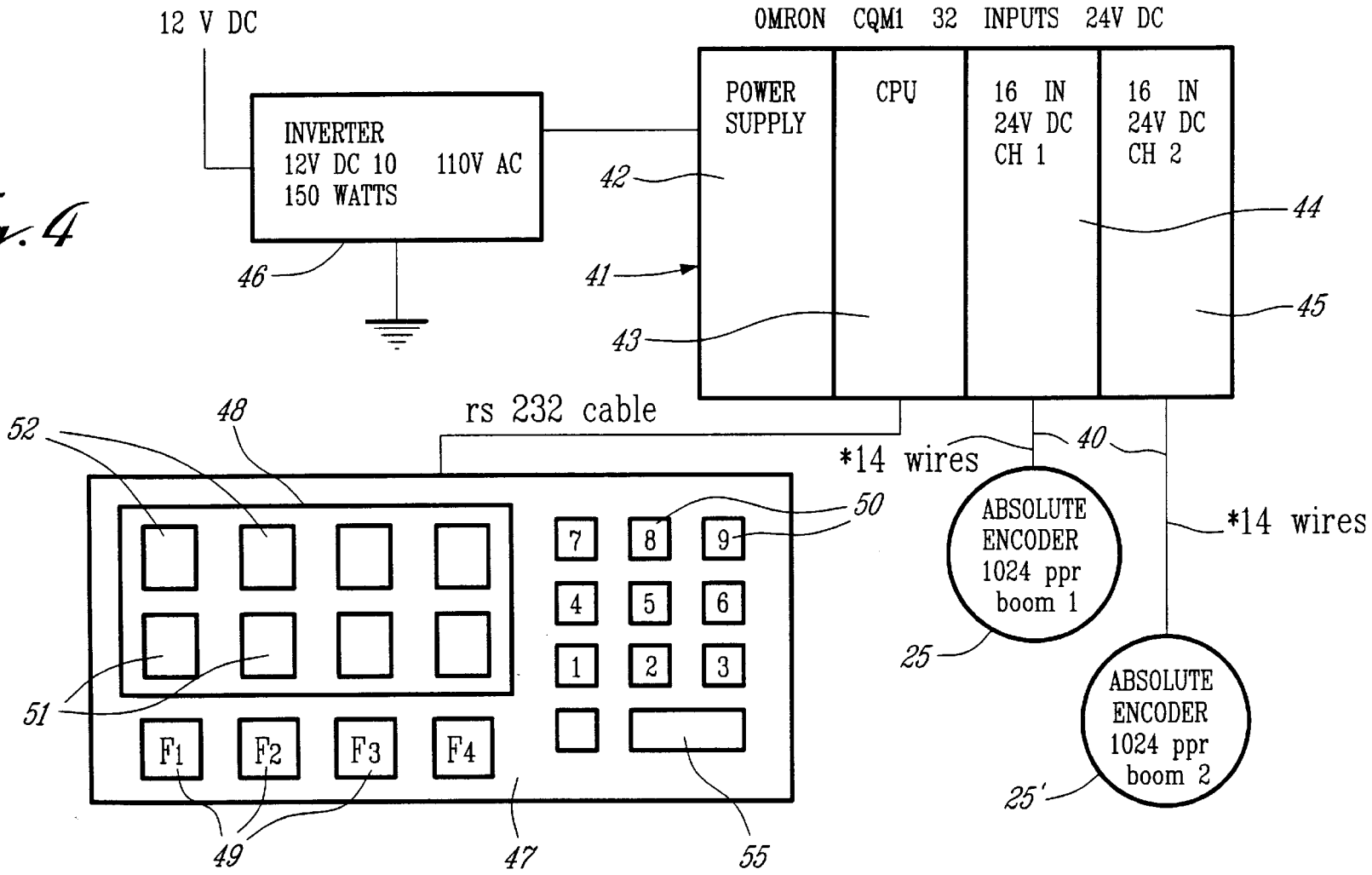
FIG. 4 is a block diagram showing the computerized system.

As shown in FIG. 4, the electronic processing (CPU) system 41 is provided with a power supply 42, a central processing unit 43 and two channels 44 and 45 feeding the CPU and associated respectively with the sensors 25 and 25' connected to the boom and dipper stick. An inverter 46 feeds the power supply 42 and connects to the 12 volt D.C. battery of the digging machine (not shown). A console 47 is mounted in the cabin 32 and accessible to the operator of the machine. It is provided with a visual display 48, function buttons 49 and data entry buttons So to enter the desired data concerning hole depth and slope angle pitch. Each of the sensors has an integrated micro-computer (not shown) which permits it to determine its position in degrees which are transmitted to the CPU 43 through the channels 44 and 45 and which converts these signals into percentages which are displayed in the windows 51 on the display 48. The display can also be provided as a computer screen. The windows 52 display hole depth.

The horizontal level 12 or any position where the teeth of the bucket are positioned represents 0 degrees or 360 degrees when programming the system to set a virtual zero degree setting. Once the system is set to virtual zero, the sensor 25 will read the position of the first and second pivots and the sensor 25' will read the position of the second and third pivots. Each of the sensors will transmit signals in degrees in their respective channels to feed the CPU 43 which treats these signals and feeds the resultant signal to the display on the console 47.

During calibration of the system, the operator enters the length of the boom 15 from pivot 17 to pivot 21 into the computer and this information is stored in the memory of the computer. This is done by the use the keyboard 50 and the ENTER switch 55. Secondly, the operator measures the distance from the pivot 21 to the tip of the digging teeth 30 and enters this measurement into the memory of the computer in the same fashion. The combined dipper stick and bucket measurement is taken with the dipper stick and bucket aligned as shown in position 1 in FIG. 1 and namely lying in alignment on the axis 31.

As illustrated in FIG. 1, when the boom is at "position 1", the second pivot connection 21 and the third pivot connection 24 are in alignment on a horizontal axis and it represents a reference point of 0 degrees which is entered into the computer by the operator. As previously described, the bucket teeth 30 have already been aligned with the dipper stick 19 or may be aligned at this instance. If after entering this virtual zero signal into the computer the dipper stick was to be displaced to its "position 2", as herein illustrates in phantom lines, a position which is 90 degrees from the horizontal, the computer will generate a negative signal. However, if the virtual zero signal is entered with the dipper stick at the position shown in phantom line, wherein the dipper stick extends vertically, then if the dipper stick goes back to ground level, the computer will provide a positive signal to the operator as the bucket teeth are being displaced above the virtual zero angle setting.

The second sensor 25' monitors the position of the third pivot connection 24 to indicate the position of the bucket teeth. The sensors read the position of the pivot points 17, 21 and 22 in degrees. They transmit these signals to the computer (CPU) where they are converted into percentage to be displayed on the console. If the pivot 21 is at the same level as pivot 17, it will indicate 0 degrees. If the pivot 21 is above pivot 17, it will indicate an increase angle in degrees. If the pivot 21 is below the pivot 17, a console will be fed a negative degree signal. To indicate the hole depth, it is the same principle except that the signals will be converted in inches or centimeters depending on the "mode" switch F1 for imperial measurements or F2 for metric measurements.

The virtual zero signals are set by the operator on the keyboard and this can be done during the excavation of the hole by positioning the digging teeth 30 on a ground surface and the operator will depress the function switch 1 to enter hole depth and switch 2 for the slope inclination angle. Once the switch buttons are depressed he can then effectuate his zero setting. The computer will then display positive or negative signals to the operator so that he is continuously updated on depth as well as inclination angle of the slope as he operates the machine. For example, if the operator wishes to dig a hole of six feet deep with a slope pitch of 15 percent at both ends, he resets the first function switch 1 enter at the level reference. The second function switch 2 enter is reset on the top of the slope. The operator begins digging the slope until he sees −15 on the display 51 and he keeps this pitch until he sees −72 on the screen. On the other end of the excavation he resets the second function 2 enter from the bottom of the excavation and then begins to excavate the slope until he reads 15 percent positive on the display 51 and he keeps this pitch until he reaches the ground level above the hole.

Figure 5:
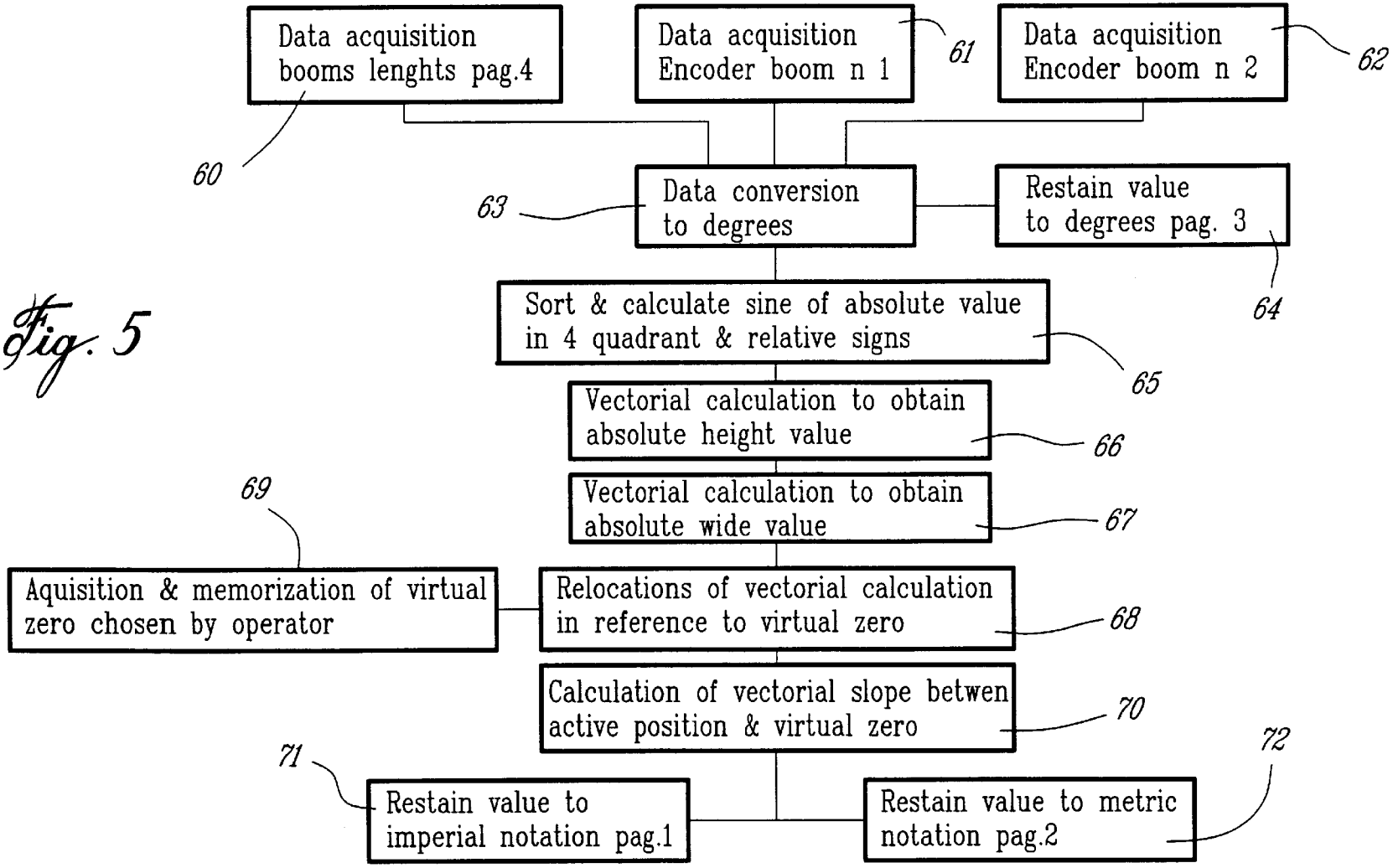
FIG. 5 is a flow chart of the program for inputting and processing the computerized system of FIG. 4.

Referring now to FIG. 5 of the drawings, there is shown the flow chart of the program for inputting information in the memory of the computer and the execution of the calculation and displays. Referring to the steps of the flow chart and as shown at step 60, the boom lengths are measured as above described and the data is entered into the computer by the keyboard 50. The step of automatic feeding the data from the sensors 25 and 25' is expressed by steps 61 and 62. All of this data is inserted in a conversion function of the system illustrated at step 63 in the computer. These values are then displayed on the screen 48 as expressed by step 64. Also, the data conversion step 63 then feeds signals to computer circuitry which effectuates the mathematical treatment of the information signals, as exemplified by step 65 and the resultant signals representative of the absolute height value are obtained in step 66 and absolute flow value in step 67. These values are processed in step 68 in relation to a virtual zero setting signal as entered into the memory of the computer by the operator and representative at step 69. The computer then calculates the vectorial slope angle between active position and the virtual zero signal in step 70 to feed the display 51 with a degree signal in either the imperial notation represented by step 71 or the metric notation as represented by step 72.

It is within the ambit of the present invention to cover any obvious modifications of the preferred embodiment described herein, provided such modifications fall within the scope of the appended claims.

What is claimed is:

1. An automatic monitoring and display system in combination with a digging machine for excavating a hole having a predetermined depth and an excavation slope pitch from ground level to hole depth, said digging machine having a boom with a first pivot at a near end connected to a machine body, a dipper stick pivotally connected to a far end of said boom by a second pivot, a bucket pivotally connected to a far end of said dipper stick by a third pivot, said bucket having digging teeth at an extreme lower edge thereof, a first inclinometer sensor secured to said boom close to said first pivot, a second inclinometer sensor secured to said dipper stick close to said second pivot, a first visual aligning marker on said far end of said dipper stick and disposed for visual access to a machine operator position, a second visual aligning marker on said bucket and disposed for alignment with said first marker, said first and second markers, when aligned, positioning said digging teeth in alignment with a longitudinal axis of said dipper stick passing through said second and third pivot; memory storage means for storing signals indicative of boom length between said first and second pivot, and combined length of said dipper stick and bucket from said second pivot to said digging teeth of said bucket and mathematical information for calculating excavation depth and excavation slope angle; processor means for processing position signals received from said first and second inclinometer sensors relative to a preset virtual zero signal, said processor means feeding resultant signals to a display means for providing a visual display to a machine operator indicative of excavation depth and excavation slope pitch, and a console having first function switch means for programming for desired hole excavation depth and second function switch means for programming desired slope pitch, said display means providing continuous visual signals to a machine operator indicative of actual excavated depth and slope at all times during excavation.

2. An excavation system as claimed in claim 1 wherein said processor means includes a data converter to convert said position signals received from said first and second inclinometer sensors to convert them in degrees to provide a pitch angle display on said display means.

3. An excavation system as claimed in claim 1 wherein said first and second function switch means are push-button switches associated with respective functions of said processor means to display excavation depth and slope pitch angle of excavation, respectively.

4. An excavation system as claimed in claim 3 wherein said processor means is a central processing unit.

5. An excavation system as claimed in claim 4 wherein said virtual zero is a ground reference point which is entered into said central processing unit at the beginning of each function of said function switches prior to entering desired data signals indicative of desired excavation depth and excavation slope angle.

6. An excavation system as claimed in claim 5 wherein said display means will display negative or positive information signals dependent on the position of said virtual zero signals for each said function.

7. An excavation system as claimed in claim 6 wherein said display is a dual display means displaying information signal of actual depth and actual slope angle simultaneously.

8. An excavation system as claimed in claim 1 wherein said first and second inclinometer sensors have a sealed housing having a plumb weight device pivotally mounted therein to provide a true vertical position reference signal, and means to secure said sealed housing.

9. An excavation system as claimed in claim 1 wherein said virtual zero signal corresponds to the surface of the ground where a hole with a sloped pitch is to be excavated or any other reference point selected by a machine operator.

* * * * *